US006149135A

United States Patent [19]

Hlavin

[11] Patent Number: 6,149,135

[45] Date of Patent: Nov. 21, 2000

[54] PORTABLE POLE SYSTEMS FOR SUPPORTING FENCING, GAME NETS, ROPE LINE DIVIDERS, AND FOR LANDSCAPING USES, AND THE LIKE

[75] Inventor: Dale J. Hlavin, Westlake, Ohio

[73] Assignee: Markers, Inc., Avon Lake, Ohio

[21] Appl. No.: 09/233,222

[22] Filed: Jan. 19, 1999

[51] Int. Cl.[7] ..... E04H 17/16

[52] U.S. Cl. ..... 256/24; 256/12.5; 256/19; 256/56

[58] Field of Search ..... 256/12.5, 19, 23, 256/25, 29, 42, 47, 50, 53, 54, 56, DIG. 2, DIG. 3, 24

[56] References Cited

U.S. PATENT DOCUMENTS

| | | | |
|---|---|---|---|
| 218,747 | 8/1879 | Hulbert | 256/54 |
| 774,295 | 11/1904 | Wheeler | 256/53 |
| 963,004 | 6/1910 | Hicks | 256/54 |
| 1,054,164 | 2/1913 | Arnwine | 256/56 |
| 3,820,758 | 6/1974 | Berg, Jr. et al. | 256/47 X |
| 4,763,879 | 8/1988 | Wasicek et al. | 256/56 X |
| 4,787,601 | 11/1988 | Rybak | 256/19 |
| 5,180,143 | 1/1993 | Brower | 256/19 X |

*Primary Examiner*—Lynne H. Browne
*Assistant Examiner*—David E. Bochna
*Attorney, Agent, or Firm*—Thomas M. Schmitz

[57] ABSTRACT

A movable pole system supporting divider material such as fencing, netting, or rope divider between a plurality of laterally spaced vertical poles orientated in a predetermined ground pattern. Each pole contains one or more connectors secured to the exterior surface of the pole for supporting the mesh material. Each connector includes a quick connect and disconnect mechanism comprising at least three outwardly extending elbows each with a vertically disposed arm. The upwardly extending vertical arms are in cooperative combination with the downwardly depending vertical arms to facilitate connection and disconnection of the fencing, provided the exterior vertical arms are opposed in direction to the intervening interior vertical arm.

16 Claims, 4 Drawing Sheets

PORTABLE POLE SYSTEMS FOR SUPPORTING FENCING, GAME NETS, ROPE LINE DIVIDERS, AND FOR LANDSCAPING USES, AND THE LIKE

This invention pertains to portable pole systems adapted to be easily installed and removed as desired, and particularly useful for supporting fencing systems for enclosing or defining sports playing fields, or for maintaining crowd control in public areas, or for pole systems supporting game netting between two or more poles for outdoor athletic games, or for supporting trees, bushes, and plants in landscaping systems. The removable vertical poles are adapted to be easily installed and maintained while in use but readily removable as desired after use to convert the area to an open space or to redefine the area for other use.

BACKGROUND OF THE INVENTION

The portable pole system of this invention is particularly useful for supporting fencing and the like where the poles can be easily removed after use to enable multiple use of the same ground area and facilitate conversion from one pole system design to another. Conventional fence systems, for instance, ordinarily consist of permanent fence posts spaced laterally apart and anchored into the ground while supporting vertical fencing permanently secured to the vertical posts such as shown in U.S. Pat. No. 4,324,388. However, such fence systems cannot be dismantled easily and reused, but typically are permanent structures defining an enclosure.

Fence systems for crowd control or sporting events need to be temporary in nature as well as safely designed to avoid injury to both spectators and athletes. Athletic games and other gymnastic sporting events are frequently held outdoors on multi-purpose athletic fields where multiple sports such as football, soccer and baseball are held on the same field at different times of the year, but require different fencing for defining the playing field and/or maintaining crowd control. Commonly assigned U.S. Pat. No. 5,186,119 discloses a system for marking designated playing areas on multiple purpose athletic fields where vertical posts contain a spring loaded ground level attachments within a ground anchor and are adapted to bend upon impact from a player. Multiple sets of ground anchors disposed flush with the ground can mark the perimeter of a baseball playing field with an arcuate outfield fence, while another similar set of flush ground anchors can define a rectangular soccer or football playing field. In commonly assigned U.S. Pat. No. 4,787,601, a decorative border fence system is disclosed comprising removable vertical posts inserted directly into the ground or fitted into an aligned arrangement of ground anchors set flush with the ground to define a divider for landscaping purposes or for marking pathways on golf courses.

It now has been found that a system of vertical poles fitted with a plurality of attachment means adapted to provide easy attachment of mesh fencing, netting, or roping with the vertical poles at multiple points to facilitate the installation and removal of temporary pole installations. Each pole contains at least one attachment means comprising a connector having a multiplicity of vertically orientated aligned prongs interacting to facilitate quick connection and disconnection of the fencing, netting, or roping to the respective vertical poles. The pole system is particularly suitable for removable fences and the like but can be adapted for semi-permanent fence systems as well. The multiple pole and fence system can be easily assembled or dismantled as desired to define sports playing areas and provides a particularly safe environment to spectators, players, and others coming in contact with the poles or the fencing. The pole system can be similarly adapted for sporting events which require netting stretched between two or more vertical poles such as volleyball or tennis, especially where the nets and poles need to be removed after use. The removable pole system is similarly useful for supporting temporary rope dividers at sporting events such as golf tournaments to provide temporary vehicular traffic management and direction of crowds traveling on foot paths. The removable poles with connectors are similarly useful for landscaping purposes to support trees, bushes and plants in an upright fashion. These and other advantages will become more apparent by referring to the drawings and the detailed description of the invention.

SUMMARY OF THE INVENTION

Briefly, the invention is directed to a removable pole system for supporting fencing, game netting, rope divider and similar linear dividing material in an upright vertical direction. The pole system typically comprises a plurality of laterally spaced vertical poles, mesh fencing, netting, or roping disposed between and supported by the vertical poles, and quick disconnect attachment means secured to each pole for quick attachment or detachment to the fencing, netting, or roping being supported The attachment means comprises a hollow slip fitting connector with an interior sidewall configuration matching the exterior of the pole and adapted to slip over and be secured to the exterior surface of the pole. Each attachment means comprises an outwardly extending connector means comprising a plurality of outwardly orientated elbows with upwardly extending or downwardly depending prongs or arms interacting, where two of the outer arms extend upwardly or downwardly but in a direction opposed to the intervening center arm. The opposed configuration of an outer pair of vertical arms orientated in the same direction and interacting with the intervening center vertical arm extending in the opposite vertical direction provides quick secure connection, and a subsequent easy disconnection, with the mesh fencing, netting or roping stretched between the laterally spaced poles. A further aspect of the invention pertains to a system of two or more poles containing attachment connectors for securing and supporting attachment of a sporting game net between two vertical poles such as a volley ball or tennis net. A further aspect of the invention is use of removable poles for landscaping purposes to stake yard trees or garden plants by roping interconnecting to the connector means on the poles.

IN THE DRAWINGS

Figure 3:
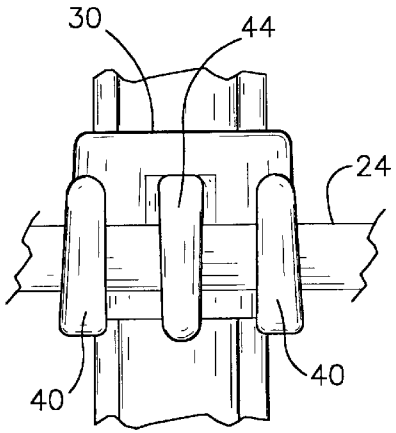
FIG. 3 is an enlarged front elevation view of one of the connectors shown in FIG. 2 but remove from the left pole and supporting an isolated horizontal member of the mesh fencing.
Figure 13A:
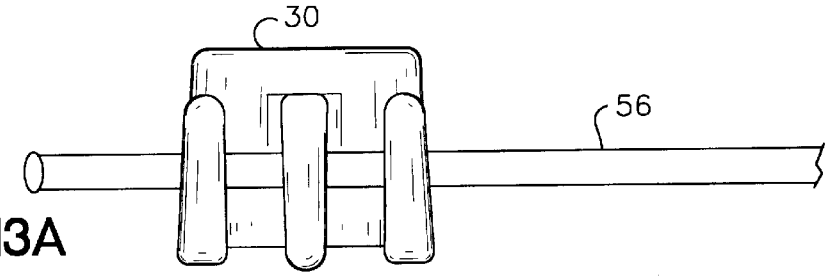
Figure 14:
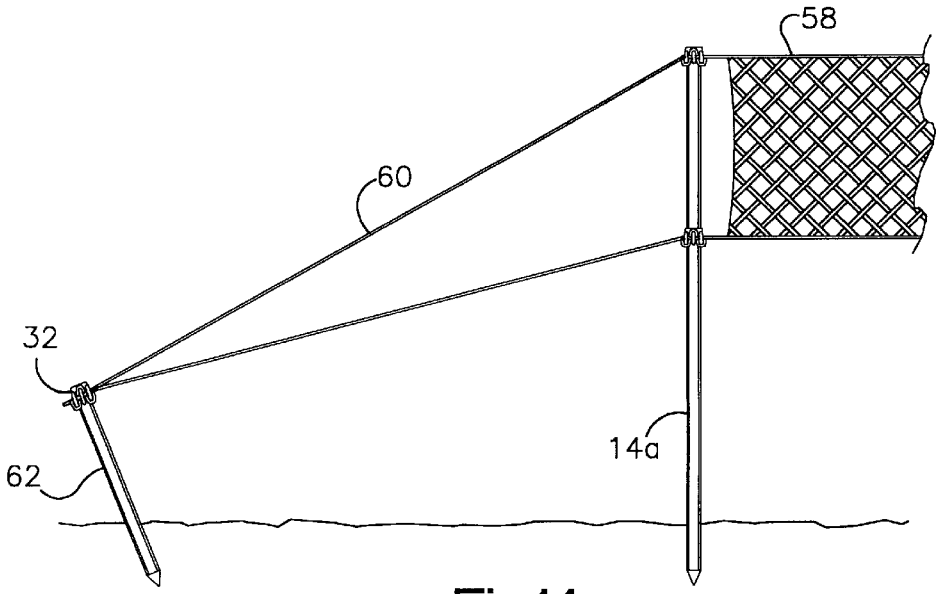

FIGS. 13A, B, C are views of the attachment connector in FIG. 3 showing a locking attachment of roping in a step wise fashion; and FIG. 14 is a partial front elevation view of a volleyball net secured to a pole according to this invention and anchored by a counteracting oblique short pole.

DETAILED DESCRIPTION OF THE INVENTION

Figure 1:
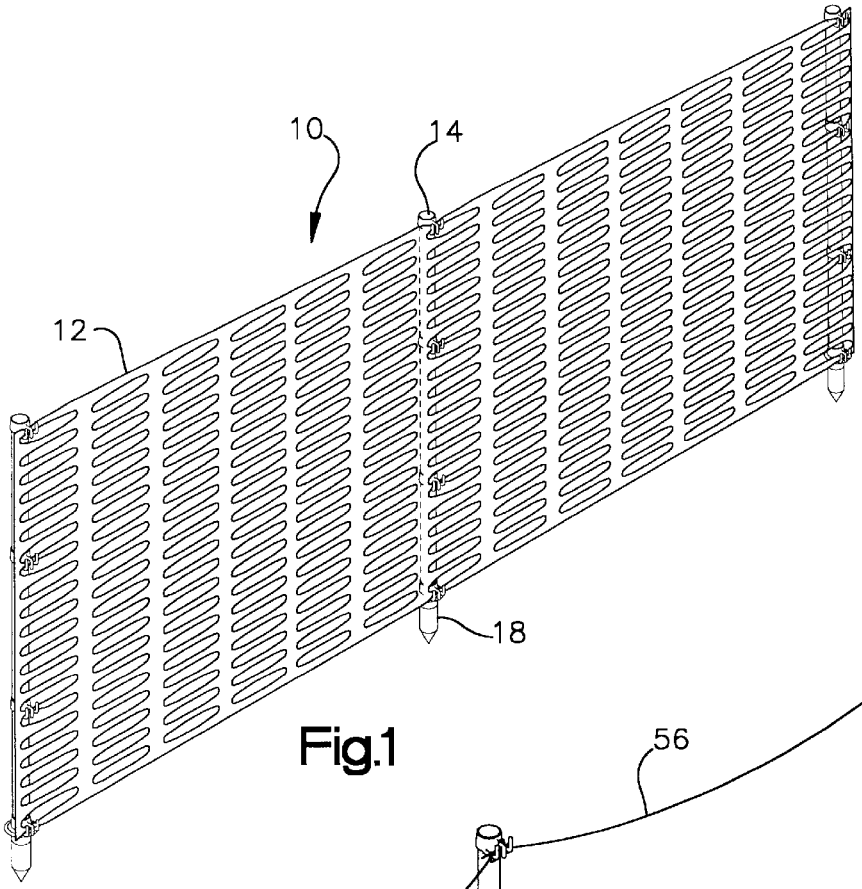
FIG. 1 is a vertical perspective view of plastic mesh fencing supported by removable poles according to this invention.
Figure 2:
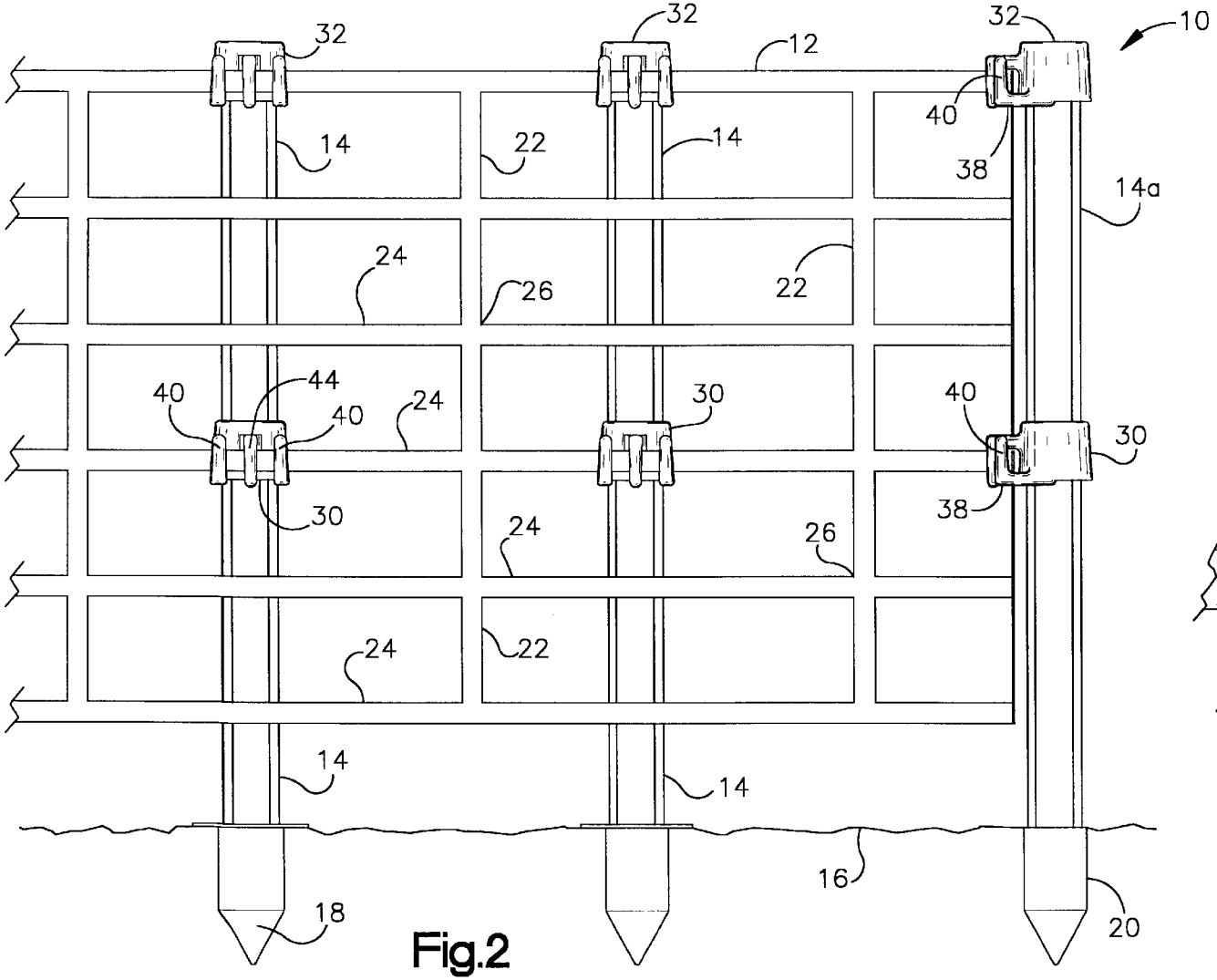
FIG. 2 is an enlarged vertical elevation view of mesh fencing supported between vertical poles by a plurality of connectors attached to the poles in accordance with this invention.
Figure 5:
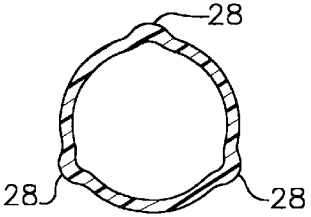
FIG. 5 is a cross sectional view of the vertical pole in FIG. 4 taken along lines 5—5.

Referring now to the drawings wherein like reference characters designate like parts, shown in FIG. 1 is a fence system 10 comprising plastic or nylon mesh fencing 12 attached to a plurality of vertical poles 14 removably supported in the ground. As best shown in FIGS. 2 and 3, the mesh fencing 12 is supported by a plurality of connector means secured midway and to the top of each of the poles 14. Poles 14 are fitted into a ground socket 18 disposed in the ground 16 while the far right pole 14*a* in FIG. 2 contains an integrally secured bottom conical point 20 adapted to be driven directly into the ground with the pole 14*a*. The structure of poles 14 and pole 14*a* can be otherwise essentially the same and together will be referred to hereafter as pole 14. The vertical poles 14 preferably are extruded circular rigid plastic tubes having a plurality of exterior linear reinforcing ribs 28 molded integrally with extruded pole 14 as best seen in FIG. 5. The mesh fencing 12 comprises a multiplicity of vertical members 22 and horizontal members 24 interwoven or interconnected at points 26 in a crosshatch configuration, where the mesh fencing 12 is typically flexible and preferably molded plastic mesh. The mesh material is open mesh material with a suitable geometric crosshatch design defining geometric mesh openings such as square, rectangular, hexagonal, diamond or triangular openings. The fence meshing 12 is supported by connector means secured to the top and intermediate sections of each pole 14 as hereafter described and shown in FIGS. 6 through 10 inclusive.

The connector means comprises a cylindrical hollow ring, preferably molded rigid plastic, where the ring configuration slip fits over the exterior of the circular pole 14. The connectors include intermediate connectors 30 shown in FIG. 9 and top cap connectors 32 shown in FIG. 10. The connectors 30, 32 are essentially the same except that top cap connector 32 contains a top wall 34. Both the intermediate connectors 30 and the top cap connectors 32 are adapted to be secured to the exterior of the poles 14 by a tight friction fit engagement with the exterior ribs 28 on the poles 14. For increased locking engagement, the connectors 30, 32 can be further secured by a set screw threaded through the circular sidewall 36 of the connector 30 to securely engage the exterior surface of the pole 14.

Figure 7:
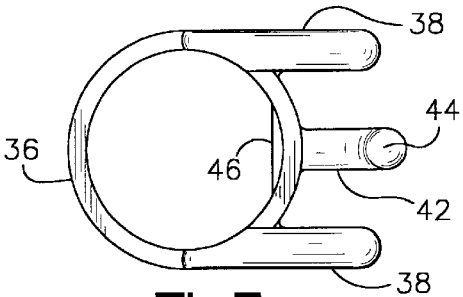
FIG. 7 is a bottom view of the connector shown in FIG. 6.
Figure 8:
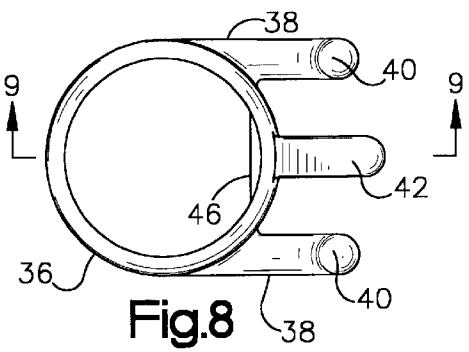
FIG. 8 is a top plan view of the connector shown in FIG. 6.

In a preferred aspect of this invention, the interior circumferential surface of the cylindrical ring connectors 30, 32 contains a raised surface 46, such as a raised flat or chord structure on the interior circular surface, adapted to tightly engage by compression friction at least one of the raised exterior linear ribs 28 on the exterior surface of the pole 14 to provide secure mechanical locking engagement with the raised rib 28. The raised surface 46 is adapted to slip fit between two of the circumferentially spaced linear ribs 28 on the exterior of the pole 14 when slip fitting the connector 30, 32 over the exterior surface of the pole 14. The connectors 30, 32 can contain one or more raised surfaces 46 circumferentially spaced on the interior surface off sidewall 36, where the raised surface 46 fits between the two raised linear ribs 28 on the exterior of the pole 14 and provides locking engagement with the raised linear rib 28 when twisted circumferentially. The raised surface 46 preferably is a raised flat or chord structure on the interior ring surface, as shown in FIGS. 7 and 8, but can be a raised arcuate shoulder. The raised surface 46 has a dimensional less than the circumferential dimension between two linear ribs 28 on the exterior of the pole 14 to enable slip fitting of the connectors 30, 32 between adjacent ribs 28 on the exterior of pole 14. After slip fitting a connector 30, 32 over the exterior surface of a pole 14, the connector 30, 32 can be rotated circumferentially to provide tight locking engagement between the raised surface 46 and the pole 14 by compressive friction of the raised surface 46 with an adjacent protruding linear rib 28.

The structure of the connectors 30, 32 can be essentially the same except that the top cap connector 32 preferably includes a top wall member 34. Otherwise, the hollow connectors 30, 32 comprise a cylindrical sidewall 36 containing at least three integrally molded, outwardly extending substantially parallel elbows with horizontal extensions and vertically orientated prongs or arms. The arms are disposed in an opposed vertical configuration adapted to interact and securely maintain attachment of the mesh fencing 12 to the connectors 30, 32. The three elbows consist of two external elbows 38 with a vertical arm member 40 extending in one vertical direction and an intervening center elbow 42 with a vertical arm member 44 extending in the opposite direction. The vertical arm members 40 of the external elbows 38 extend in the same direction, either upwardly or downwardly, while the vertical arm member 44 of the intervening central elbow 42 extends in the opposed vertical direction. In FIGS. 6 through 10, for example, three elbows project laterally outward from the cylindrical sidewall 36 consisting of two external elbows 38 with upwardly extending arm members 40 in combination with a downwardly directed center arm member 44 on the center elbow 42. The cooperating upwardly and downwardly directed arm members can be orientated as described, or reversed, provided the exterior two arm members 40 extend upwardly or downwardly but in a direction opposed to the center arm member 44. For structural reinforcing reasons, the raised interior surface 46 preferably is located on the interior sidewall 36 opposite the molded elbows 38, 42, as viewed in FIGS. 7 and 8.

In FIG. 3, an intermediate connector 30 is shown with an isolated horizontal member 24 of the mesh fencing 12 passing behind the upwardly extending external arms 40 and the downwardly depending center arm 44. The downwardly depending center arm 44 is preferably molded to the exterior sidewall 36 of the connector 30 at a point vertically above the uppermost terminal ends of the upwardly directed exterior arms 40 to facilitate insertion of the horizontal member 24 upwardly behind the center arm 44 but in front of the two external arms 40, and then downwardly behind the two external arms 40 and in front of the connector cylindrical sidewall 36. The opposed vertical arm configuration with a spaced height differential provides a quick connection or disconnection means for securing the mesh fencing 12 to the vertical poles 14.

Figure 6:
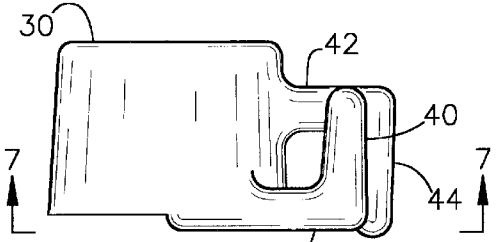
FIG. 6 is an enlarged vertical elevation view of the connector shown in FIGS. 2 and 3.
Figure 9:
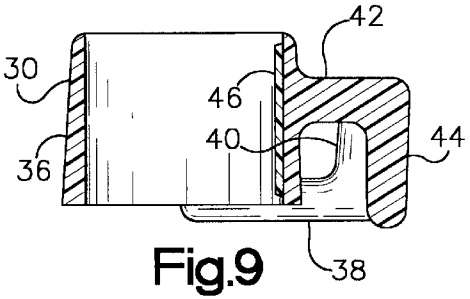
FIG. 9 is a vertical sectional view of the connector taken along lines 9—9 in FIG. 8.
Figure 10:
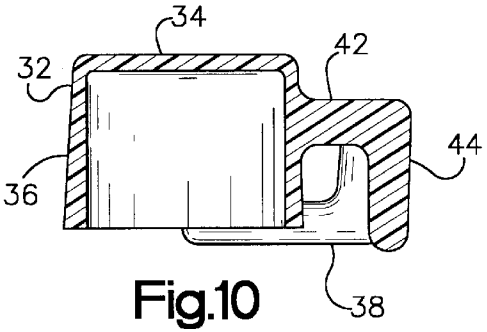
FIG. 10 is a vertical sectional view similar to FIG. 9 but of a connector cap for attachment to the top of the vertical pole.
Figure 4:
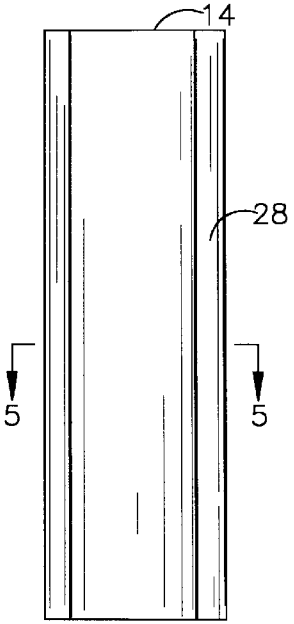
FIG. 4 is an enlarged elevation view of a vertical pole shown in FIGS. 1 and 2.

In FIG. 6, a preferred structural design of the connector 30, 32 is shown, where the center elbow 42 extends radially outwardly beyond the external elbows 38 and thus center vertical arm 44 displaced slightly laterally outwardly beyond the lateral extension of the two external elbows 38. The radially extending and slightly laterally outward displacement of the center vertical arm 44 facilitates insertion of the mesh fencing between the external arms 40 and center arm 44 for secure placement of the horizontal member 24 of the mesh material 12 behind all three vertical arms. Radial extension of the center vertical arm 44 laterally beyond the exterior vertical arms 40 facilitates a quick connecting or disconnecting engagement of the mesh fencing 12 with a connector 30, 32 as well as maintain the mesh fencing 12 secure by engaging the horizontal member 24 of the interwoven mesh fencing 12 between the vertical arms 40, 44 and the connector sidewall 36.

The mesh fencing 12 can be stretched in front of and attached to intermediate poles 14 by connectors 30, 32 facing outwardly. Pole 14*a* can be an end pole, as viewed in FIG. 2, with connectors 30, 32 facing left to secure the end of the mesh fencing 12. Similarly, pole 14*a* can be a directional change pole, such as a corner pole, where the mesh fencing 12 passes in front of the pole 14*a* but changes direction. In this instance, the mesh fencing 12 would angle outwardly, with the connectors 30,32 orientated to the left to maintain lateral tension on the mesh fencing 12. In a similar manner, the end pole 14*a* can be a directional change pole, such as right angle inwardly, with the mesh fencing 12 passing in front of pole 14*a* and wrapping around the end pole 14*a*. In this instance, the directional orientation of the connectors 30, 32 would be outwardly or to the right, as viewed in FIG. 2, to secure and maintain tautness of the stretched mesh fencing 12 around the end pole 1 4*a*. In still another aspect of the invention, two end poles 14*a* can be spaced laterally apart with a mesh netting disposed between and secured taut within the connectors 30,32 attached to the pair of spaced end poles 14*a*.

In FIG. 2, the end pole 14*a* is shown without a ground socket but instead with an integral or securely attached conical point 20 for direct insertion into the ground. The conical ground point 20 can be easily inserted into or removed from the ground consistent with this invention but without the convenience of a preset pattern of ground sockets.

Figure 11:
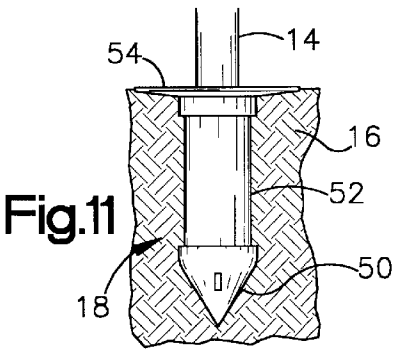
FIG. 11 is a front elevation view of a ground socket for a removable vertical pole.

A particular advantage of the fencing system of this invention is that the mesh fencing 12 can be quickly attached and detached from the connectors 30, 32, and the vertical poles 14 can easily be removed from ground sockets 18 to convert the defined playing field to an open field or to another sporting field configuration. Similarly, a crowd control fence system can be assembled for a particular public event and then quicky dissembled and removed after the event, but then quickly reassembled and used again later in the same ground sockets and pattern for the same purpose. The ground sockets 18 can remain permanently in the ground for future use and like events but unobtrusive for subsequent other use of the same area. A permanent ground socket 18 of the type shown in U.S. Pat. No. 4,787,601 is illustrated in FIG. 11 comprising a conical end point 50, a hollow cylindrical intermediate section 52, and a peripheral flat top collar 54 adapted to set flush with the ground 16. Ground sockets 18 can be fitted with a removable protective plastic plug for capping the opening to the ground socket when not in use.

In accordance with this invention, a fencing system can be plotted in a predetermined pattern or design by locating ground sockets 18 flush with ground in alignment consistent with the intended design layout for the fence. Poles 14 including an end pole 14*a* where desired are inserted into the ground sockets 18. Connectors 30, 32 are slipped over the poles 14, 14*a* and locked in place by rotating each connector 30,32 circumferentially to securely engage the interior raised surface 46 with an adjacent protruding rib 28 on the exterior of the pole 14. Mesh fencing 12 can be easily attached to the connectors 30, 32 by slipping horizontal members 24 of the mesh fencing 12 upwardly in front of the external vertical arms 40 but behind the laterally spaced outwardly center vertical arm 44, as shown in FIG. 3, and then slipped over the top of the upright exterior arms 40 to become engaged inside the external vertical arms 40 and laterally adjacent to the connector sidewall 36.

In use, the connectors 30, 32 support and maintain the fencing 12 taut and vertical. After the temporary use of the fencing system, the fencing can be easily removed by raising the horizontal member 24 over the upright exterior arms 40 and lowering through the lateral spacing between the exterior arms 40 and the laterally displaced center arm 44. The poles 14 can be removed from the ground sockets 18 which can remain flush in the ground and unobtrusive for subsequent use of the same ground area. The ground sockets can be capped if desired until later when the ground sockets 18 are reused in setting up the same fencing configuration.

Figure 12:
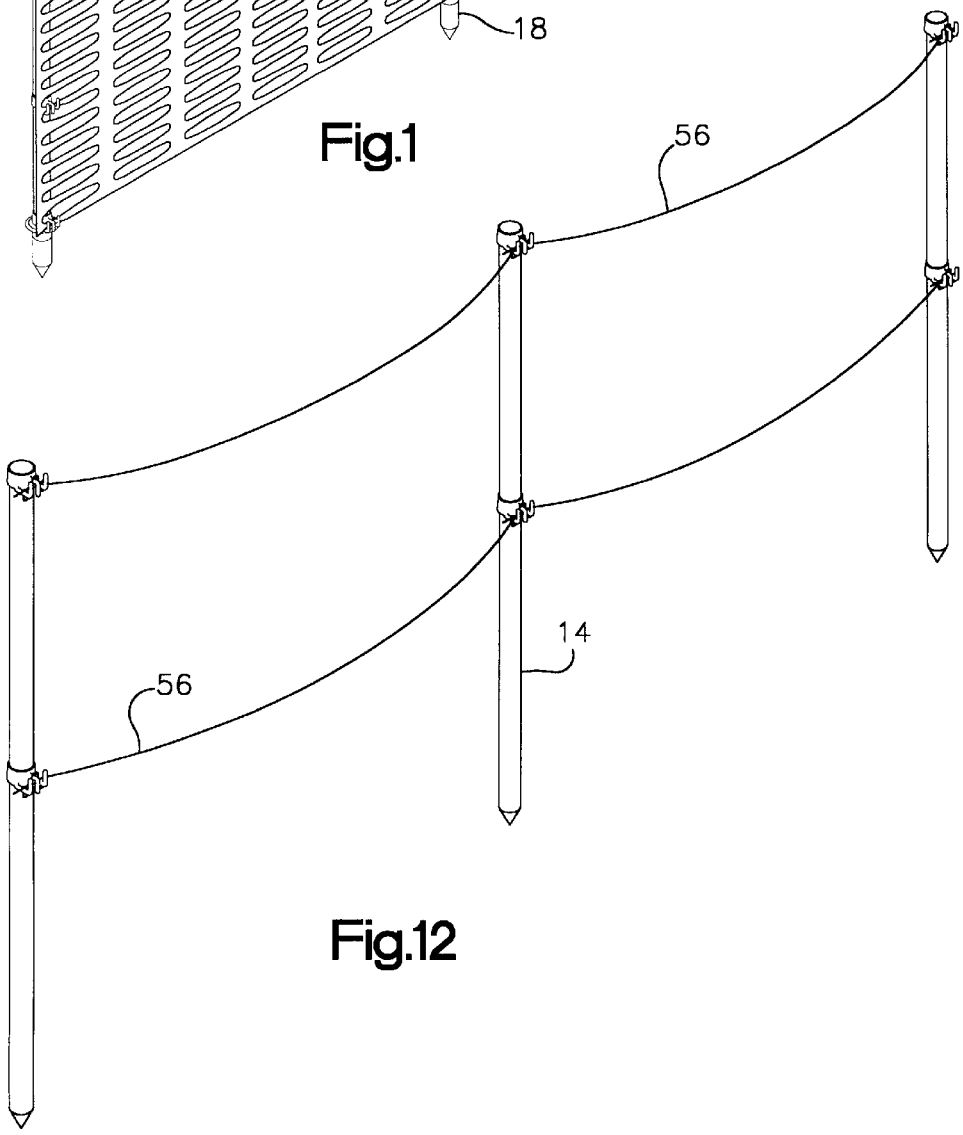
FIG. 12 is a perspective view of a roping divider fence system similar to FIG. 1.
Figure 13B:
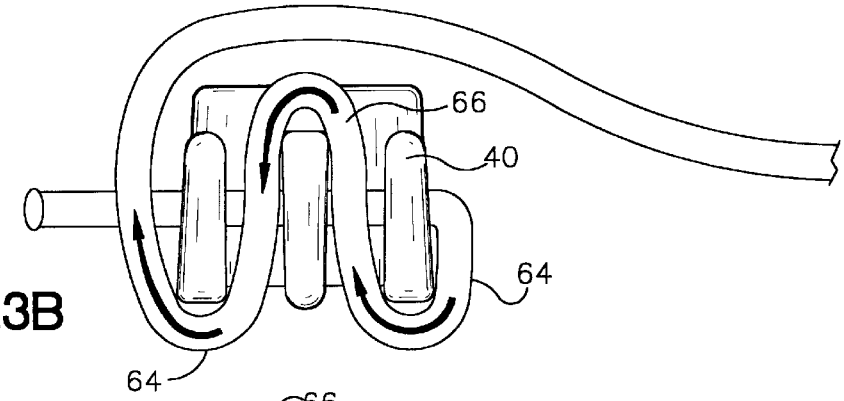
Figure 13C:
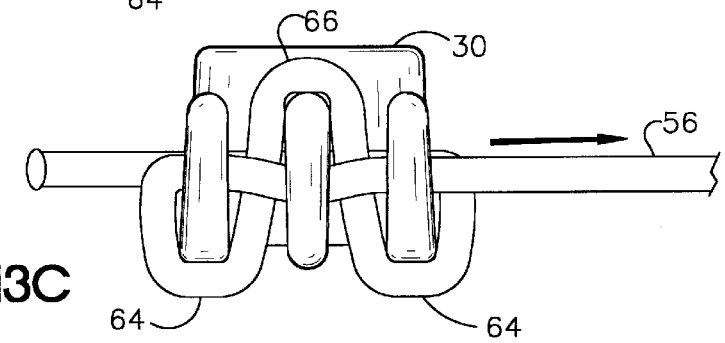

Referring now to FIG. 12, shown is a multiple rope fencing system useful as a divider fence for directing vehicular or pedestrian traffic control where lateral roping 56 is secured to multiple poles 14 in a manner similar to the fencing system in FIG. 1. In this aspect of the invention, one or more lateral ropes 56 can be can be connected to connectors 30, 32 attached to removable poles 14 to define temporarily an area or a pathway for crowd or vehicular movement. The horizontal ropes 56 are readily supported and secured by interweaving within the opposed vertical arms 40, 42 configuration of the connectors 30, 32 With reference to FIG. 13, the rope 56 can be secured to the connectors 30, 32 attached to selected poles in the system, particularly the end poles 14*a*, by passing rope 56 behind the three vertical arms 40, 44, 40, as shown in FIG. 13A, then tightly looping the rope 56 outside (below) the exterior elbows 38 to form lower external loops 64, while similarly forming an upper center loop 66 outside (above) the central elbow 42, as shown in FIG. 13B. The looped rope 56 is secured tightly by looping the rope 56 to pass behind the upright external arms 40, and then similarly interweaving the rope 56 behind the downwardly depending center arm 44 but in front of center loop 66 to secure a knotting connection within the respective connector 30, as shown in FIG. 13C. For connector configurations where the vertical arm orientation is inverted, the looping knot connection can be likewise reversed. Not all rope connections need to be knotted but some intervening connections can simply consist of the rope 56 being placed behind the upright arms 40, 44, as shown in FIG. 13A, in the same manner as the horizontal member 24 of mesh fencing 12 can be located behind the upright arms 40, 44 and adjacently in front of the exterior cylindrical sidewall 36 of connectors 30, 32 Thus, the connectors 30, 32 provide support while hold taught the horizontal ropes 56 to provide a removable rope divider fence system, which can be easily assembled and disassembled in accordance with this invention.

In another aspect of this invention, a volleyball or a similar game net 58 can be secured between two end poles 14*a*, shown partially in FIG. 14, where one end pole 14*a* is secured to the net 58 stretched taught between two end poles 14*a*. Frequently end poles 14*a* used for game nets 58, or for end poles in fencing or roping systems, encounter extra lateral forces in the direction of the stretched material. To counteract this lateral pull, small anchor poles 62 of the same structure as poles 14 can be inserted into the ground at an oblique angle directed away from the end pole 14*a*. The short anchoring poles contain an anchoring connector of the same structure as connectors 30, 32, which are attached to anchoring ropes 60 attached to an end pole 14*a* to counteract the lateral force pulling in the opposite direction. The end pole 14*a* shown in FIG. 14 is maintained upright by two counteracting angled ropes 60 secured to a short anchor pole 62 fitted with a three prong top connector 32 and driven into the ground at an oblique angle opposing the lateral stretch force of the game net 58. The anchoring ropes 60 can be secured to the end pole 14*a* and to the angled ground pole 62 by the interweaving knot connection shown in FIG. 13. Thus, angled anchoring poles 62 can be utilized to support vertical end poles 14*a* subject to lateral pull due to lateral stretching forces imposed on end poles 14*a* used for the fencing in FIG. 1, or for the roping divider system shown in FIG. 12, or for the game net shown in FIG. 14. Similarly, the removable pole system of this invention can be adapted for a variety of uses to provide vertical support to landscaping items by interconnecting roping with a connector 30, 32 to maintain an end pole 14*a* vertical and maintain supporting attachments vertical. Thus, end poles 14*a* can provide temporary vertical support for new landscaping trees, bushes and plants, where the vertical pole 14 ordinarily functions as an end pole 14*a* maintained vertical by anchoring ropes 60 attached to short anchoring poles 62.

Although preferred aspects of the invention have been described in connection with the drawings, the invention is not intended to be limited except be the appended claims.

What is claimed is:

1. A portable pole system supporting liner dividing material stretched between two or more vertical poles, the linear dividing material being mesh fencing or netting or rope divider or the like, the linear dividing material stretched between vertical poles adapted to be held upright and define spacing by the pole system, the pole system comprising:

a plurality of vertical poles adapted to be secured upright in the ground, each pole fitted with at least one, connector means for supporting the linear dividing material vertically with the ground;

each connector being a hollow device comprising a sidewall configuration with an interior surface adapted to slip fit over the exterior surface of the vertical pole, where each connector is securely engaging the exterior surface of one of the respective poles, where each connector has at least three spaced elbows extending, in a direction laterally outwardly from the connector, where two of the elbows are exterior elbows and the third elbow is a center elbow disposed between the two exterior elbows, each said elbow having a vertically orientated arm member, where the vertical arms of the two exterior elbows are orientated in the same vertical direction, and the vertical arm of the center elbow is orientated in a vertical direction opposite of the arms of the two exterior elbows;

the linear dividing material supported by each connector with the linear dividing material disposed between the arms of the connector and the connector sidewall to support the linear dividing material vertically;

where the poles are cylindrical rigid plastic hollow tubing substantially circular in cross section, each pole having at least three protruding linear external ribs circumferentially spaced and molded integrally with the respective rigid plastic pole to provide reinforcing linear strength to the pole, where each hollow connector comprises a cylindrical sidewall with a circular interior ring surface adapted to tightly engage the three external reinforcing ribs to secure each connector to the respective pole.

2. The pole system of claim 1 where the vertically orientated members of the elbows are substantially parallel in the vertical direction and the elbows extend laterally outwardly from the connector cylindrical sidewall.

3. The pole system in claim 1 comprising multiple poles, and the linear divider material is open mesh fencing of cross hatched material.

4. The pole system in claim 1 set up in a predetermined ground pattern marked by a series of ground sockets, where the vertical poles are portable and held upright within the ground sockets, the portable poles being removable from the ground sockets and adapted to be later reset in the same ground sockets in the same ground pattern.

5. The pole system in claim 4 where the pole system comprises intermediate poles, end poles, and directional change poles inserted in ground sockets adapting to the predetermined ground pattern for the pole system.

6. The pole system of claim 5 where the linear dividing material is one or more linear ropes supported by the connector on each pole, where the linear rope divider is in locking engagement with each connector on each end pole and some of the intermediate and directional change poles, the locking engagement being the rope interwoven with the exterior arms and the intervening center arm to provide a secure knotting connection to the respective connector.

7. The pole system in claim 6 where each rope locking engagement consists of passing the rope behind the external and central upright arms on the connector, looping the rope around the external elbows of the connector, and around the central elbow of the connector to form a center loop, and passing the rope behind the center arm but in front of the center loop to form a tight knot with the respective connector.

8. The pole system in claim 5, where the respective end poles are subjected to lateral stretch pull of the linear divider material, where the stretch pull on an end pole is counteracted by a short anchor pole driven into the ground, the anchor pole being cylindrical with at least one external protruding reinforcing rib, the anchor pole fitted with a connector to provide an anchor connector securely engaging the exterior of the anchor pole, where anchor roping is secured to the anchor connector and the respective end pole to maintain the end pole vertical.

9. The pole system of claim 1 where the connector vertical arms of the external elbows are directed upwardly, while the vertical arm of the of the center elbow is directed downwardly.

10. The pole system of claim 9 where the external vertical arms have upward terminal ends, and the connector center elbow is molded to the exterior wall of the connector upwardly relative to the external terminal ends.

11. The pole system of claim 1 where the poles are readily movable by inserting each pole into a ground socket disposed flush with the ground, where the poles can be inserted into and removed from the ground sockets as desired.

12. The pole system in claim 11 where the pole system is combined with a second pole system, where the first pole system of one ground socket pattern can be readily removed and replaced with the second pole system using a second pattern of ground sockets, where both the first and second pole systems are portable and interchangeable in the first or second pole systems respectively, and each pole system can be set up, removed, and reorientated interchangeably as desired.

13. The pole system of claim 1 where the hollow connectors contains at least one raised surface on the interior ring surface of the hollow connector, the raised surface adapted to compressively engage one of the protruding ribs to provide locking engagement of the pole with the connector.

14. The pole system of claim 13 where the raised surface comprises a raised chord structure for locking engagement with the rib on the pole.

15. The pole system in claim 1 where the pole system comprises two end poles spaced laterally apart with mesh material comprising a game netting secured between the two poles.

16. The pole system in claim 1 where the center elbow of each connector is orientated radially outwardly from the circular sidewall, and the vertically orientated arm of the center elbow is radially displaced laterally outwardly of the two exterior arms.

* * * * *